US008695116B2

(12) United States Patent
Dapo

(10) Patent No.: US 8,695,116 B2
(45) Date of Patent: Apr. 15, 2014

(54) AIR EMITTING DEVICE FOR A COSTUME

(76) Inventor: Kenwyn Patrina Dapo, New York, NY (US)

( * ) Notice: Subject to any disclaimer, the term of this patent is extended or adjusted under 35 U.S.C. 154(b) by 0 days.

(21) Appl. No.: 13/295,063

(22) Filed: Nov. 12, 2011

(65) Prior Publication Data

US 2012/0110715 A1 May 10, 2012

Related U.S. Application Data

(63) Continuation-in-part of application No. 12/179,962, filed on Jul. 25, 2008, now abandoned.

(60) Provisional application No. 60/962,167, filed on Jul. 27, 2007.

(51) Int. Cl.

| | |
|---|---|
| ***A41D 13/00*** | (2006.01) |
| ***A41C 3/00*** | (2006.01) |
| ***A63H 33/00*** | (2006.01) |

(52) U.S. Cl.

USPC ..... 2/69; 450/38; 446/26

(58) Field of Classification Search

USPC ..... 2/69, 67, 2.11, 2.14, 171.3, 239, 247, 2/DIG. 3, DIG. 10; 450/1, 38, 57; 446/26–28

See application file for complete search history.

(56) References Cited

U.S. PATENT DOCUMENTS

| | | | | |
|---|---|---|---|---|
| 1,376,219 | A * | 4/1921 | Munter | 450/119 |
| 2,050,064 | A * | 8/1936 | Neal | 450/28 |
| 2,474,115 | A * | 6/1949 | Read | 450/31 |
| 4,678,014 | A * | 7/1987 | Owen et al. | 141/67 |
| 5,336,066 | A | 8/1994 | Myers et al. | |
| 5,347,656 | A * | 9/1994 | Fabritz et al. | 2/67 |
| 5,833,515 | A * | 11/1998 | Shahbazian et al. | 450/38 |
| 6,080,037 | A * | 6/2000 | Lee et al. | 450/38 |
| 6,094,773 | A * | 8/2000 | Krentz et al. | 15/321 |
| 6,461,221 | B1 * | 10/2002 | Stilwell et al. | 450/57 |
| 2001/0019933 | A1 * | 9/2001 | Wagner | 450/37 |

FOREIGN PATENT DOCUMENTS

GB 1506719 A * 4/1978

OTHER PUBLICATIONS

Majiloon pump, website document describing the Majiloon device.

* cited by examiner

*Primary Examiner* — Alissa L Hoey
*Assistant Examiner* — Jameson Collier
(74) *Attorney, Agent, or Firm* — Schafer Smith LLC

(57) ABSTRACT

An air emitting device for use with a costume to create the illusion that air is being emitted from an anatomical body part. A wearable housing contains a source of air within the hollow compartment of a cup. A nozzle focusing the air stream protrudes from a cup. This costume enables the wearer to affix a balloon to the nozzle and inflate it, thus creating the illusion that the air is being emitted from the wearer's anatomical body part.

7 Claims, 9 Drawing Sheets

AIR EMITTING DEVICE FOR A COSTUME

RELATED APPLICATIONS

The present patent document is a continuation of application Ser. No. 12/179,962, filed Jul. 25, 2008, which claims the benefit of the filing date under 35 U.S.C. §119(e) of Provisional U.S. Patent Application Ser. No. 60/962,167, filed Jul. 27, 2007. All of the foregoing applications are hereby incorporated by reference.

BACKGROUND

This application relates to air-creating costumes which may be used for balloon inflation.

Air pumps intended for performers to use for the purposes of balloon inflation have been produced in the past—for instance, the Myers Pump, U.S. Pat. No. 5,336,066 is a hand-held device which, while very effective, does not accessorize with any particular costume, and must incorporate two hands for balloon inflation. The Majiloon pump, a battery-powered balloon pump, can be worn in a small pouch around the waist; while effective, this pump also requires two hands for operation, and its pouch and air hose mar the appearance of an otherwise well thought-out costume.

My method of incorporating an air-creating device into the design of a costume has several advantages:

a. It requires only one hand for operation.

b. The cohesive appearance of the costume does not remind the viewer than an external mechanism is being used for air-creation, thus permitting the viewer to "extend disbelief" and enjoy the performance.

c. Amusement can be achieved by the clever placement of the air nozzle.

Disadvantages to this air-creating costume are:

a. It may not be versatile enough for all performance venues.

b. It may not have the sustained power of the above-mentioned Majiloon pump.

c. Certain embodiments may be heavy.

BRIEF SUMMARY

A costume houses a source of compressed air. A nozzle focusing the air protrudes from the costume at an anatomical region, thus creating the illusion that the wearer's anatomical region is emitting a stream of air capable of inflating a balloon.

Other systems, methods, features, and advantages of the disclosure will be, or will become, apparent to one with skill in the art upon examination of the following figures and detailed description. It is intended that all such additional systems, methods, features and advantages be included within this description, be within the scope of the invention, and be protected by the following claims

Figure 1:
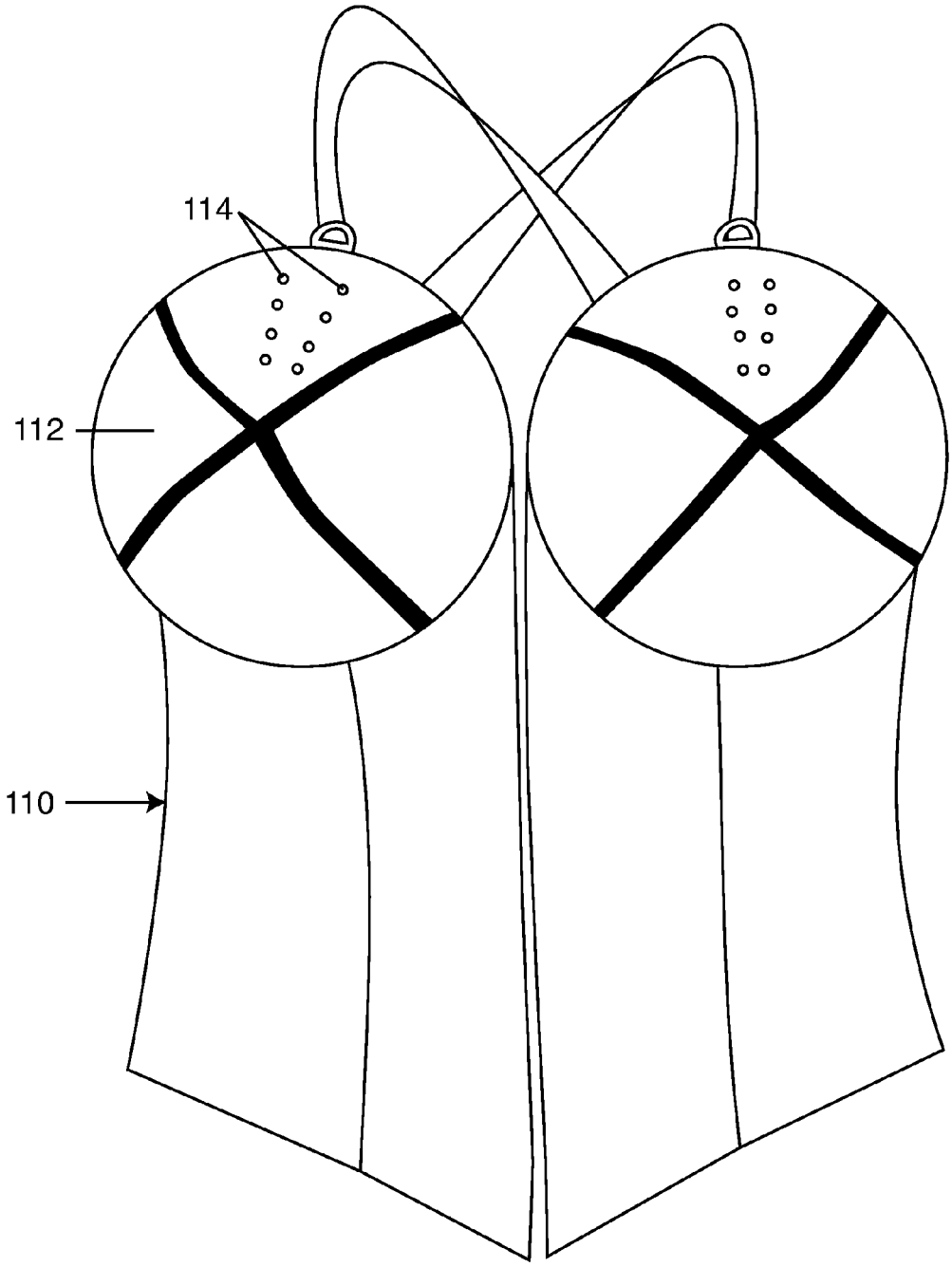
FIG. 1 shows a front view of an air creating costume.

REFERENCE NUMERALS a. 110 Corset garment
b. 112 corset cups divided in 4 panels
c. 114 grommets
d. 310 disc-shaped interior padding
e. 312 hook and loop strips
f. 410 LEXAN disc
g. 412 LEXAN disc
h. 414 holes drilled in LEXAN disc
i. 416 fabric backing
j. 418 stitching
k. 420 automotive air horn compressor
l. 422 normally-open micro switch
m. 424 12-volt electrical circuits
n. 426 clear plastic tubing
o. 428 90-degree compression fitting
p. 430 galvanized coupling
q. 432 12 volt 2-prong connector
r. 610 LEXAN disc
s. 612 hook and loop strap
t. 614 sealed lead acid battery

DETAILED DESCRIPTION OF THE DRAWINGS

A costume is provided that includes a garment and an air-emitting device. A garment may be of any shape, including but not limited to, the shape of a human figure, an animal figure, a human head, an animal head, a work of architecture, an insect, a design or art article, or any other item.

Figure 2:
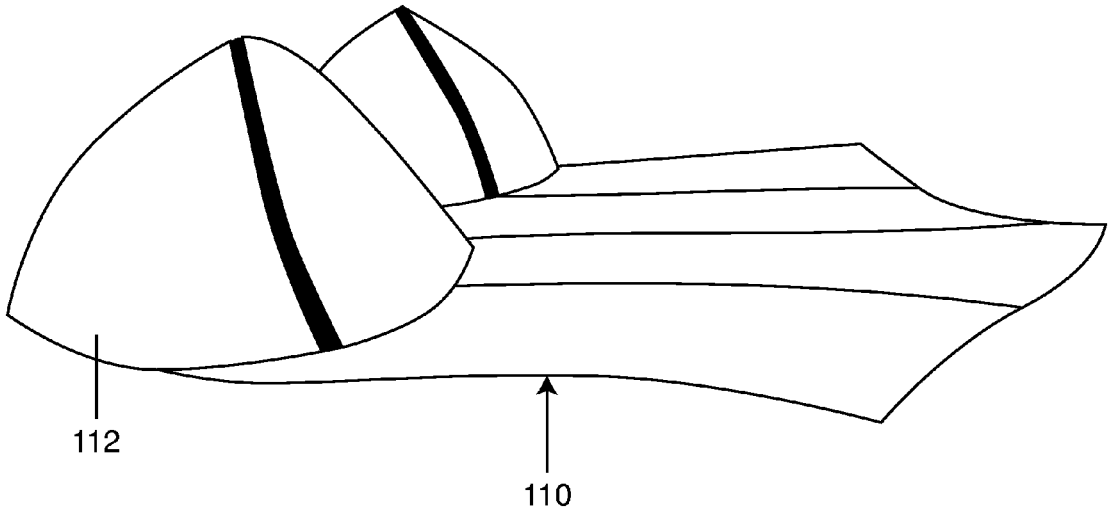
FIG. 2 shows a side view of an air creating costume.

For example, in one variation, a costume may comprise a garment and an air-emitting device. In this variation, the garment may be designed to look like the corset of, for example but not limited to, a well-endowed female, as seen in FIGS. 1 and 2. The exemplary corset garment 110 may include, for example, corset cups 112, grommets 114 and zippers (not shown), indicated by the thick black lines. Said corset garment 110 may be custom fitted to the performer's torso measurements, or may be made of a standard size which may permit wearing by individuals of multiple sizes and measurements. It may includes standard features of a corset, including straps and structural supports like boning (not shown), which will be well-known to those experienced in the costuming field. In addition, the corset garment 110 may include other features that are not common to traditional corsets, such as light-emitting elements, animal shaped cups, or other items. The corset garment's 110 may include breast cups 112 which may be constructed to be much larger than the wearer's natural breasts. While breast-shaped cups are shown, the cups may be of any shape, such as stars, squares, triangles, or any other shape. (Note: this variation may be most comfortable if the wearer is relatively flat-chested. However, the cups may be enlarged to accommodate larger chest sizes.)

Each corset cup 112 may be comprised of panels. In this example, the corset cup 112 is comprised of 4 panels. However, the corset cup may be comprised of any number of panels. In this variation, the corset cups 112 comprise 4 panels, and, between each panel is a zipper (indicated by thick black lines in FIGS. 1, 2, 8 and 9), the zipper pull of which faces the exterior of the corset cup 112. While a zipper is disclosed in this example, the zipper may be replaced with any closure device such as VELCRO, hook and eye closures, or otherwise.

When zipped closed, the corset cups 112 are brought into their closed, cone-like shape, as seen clearly in FIG. 2. While a cone-like shape is disclosed, the corset cups 112 may be dimensioned and shaped in any shape that will accommodate an air emitting device, such as a star shape, a square, a triangle, or otherwise.

The advantage to this zipper placement in this embodiment is that the zippers permit the performer to continue to wear the corset while easily loading and unloading batteries and gaining access to the air-creating mechanism when necessary. Other embodiments could feature corset cups 112 that are sewn shut, ridding them of zippers on the outside, and provide access to the hollow compartment (to be described in the following paragraph) only when the costume is entirely removed.

Figure 3:
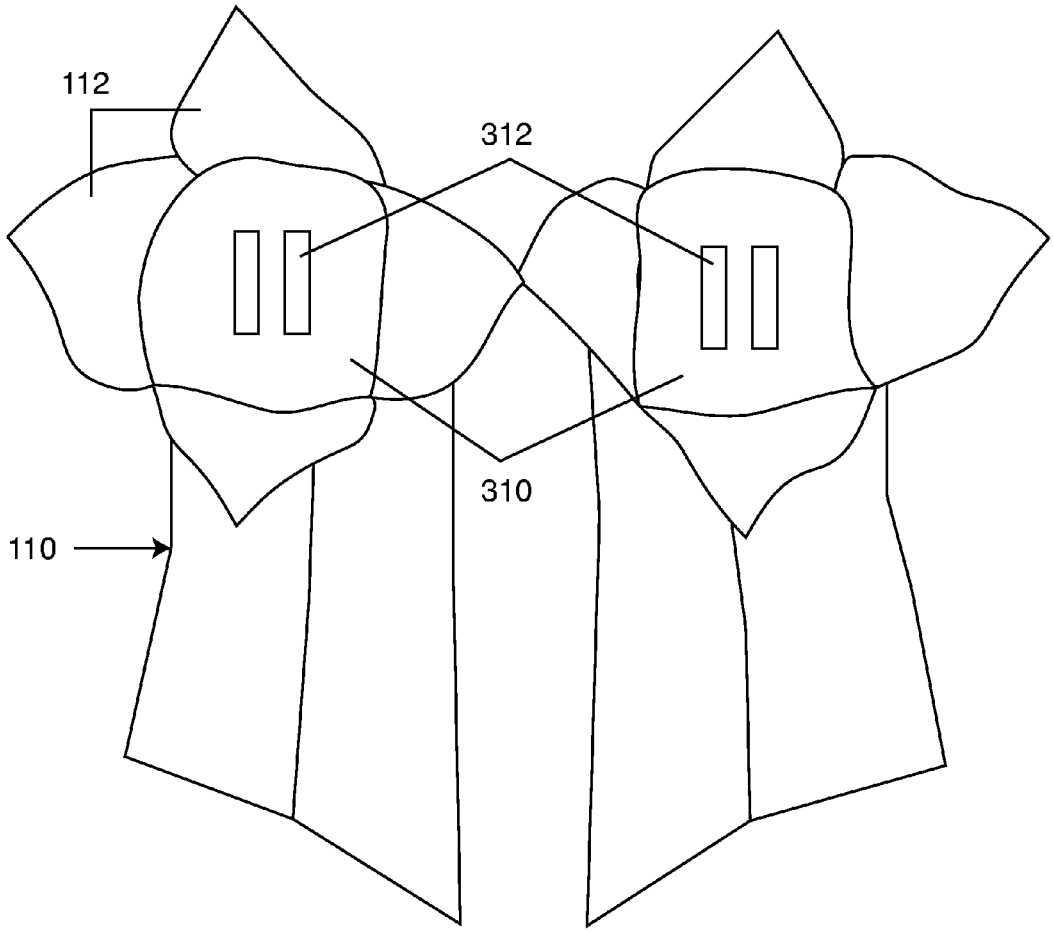
FIG. 3 shows an exemplary air creating costume illustrating an exemplary open hollow compartment of a corset garment in which the air-creating mechanism may be contained.
Figure 4:
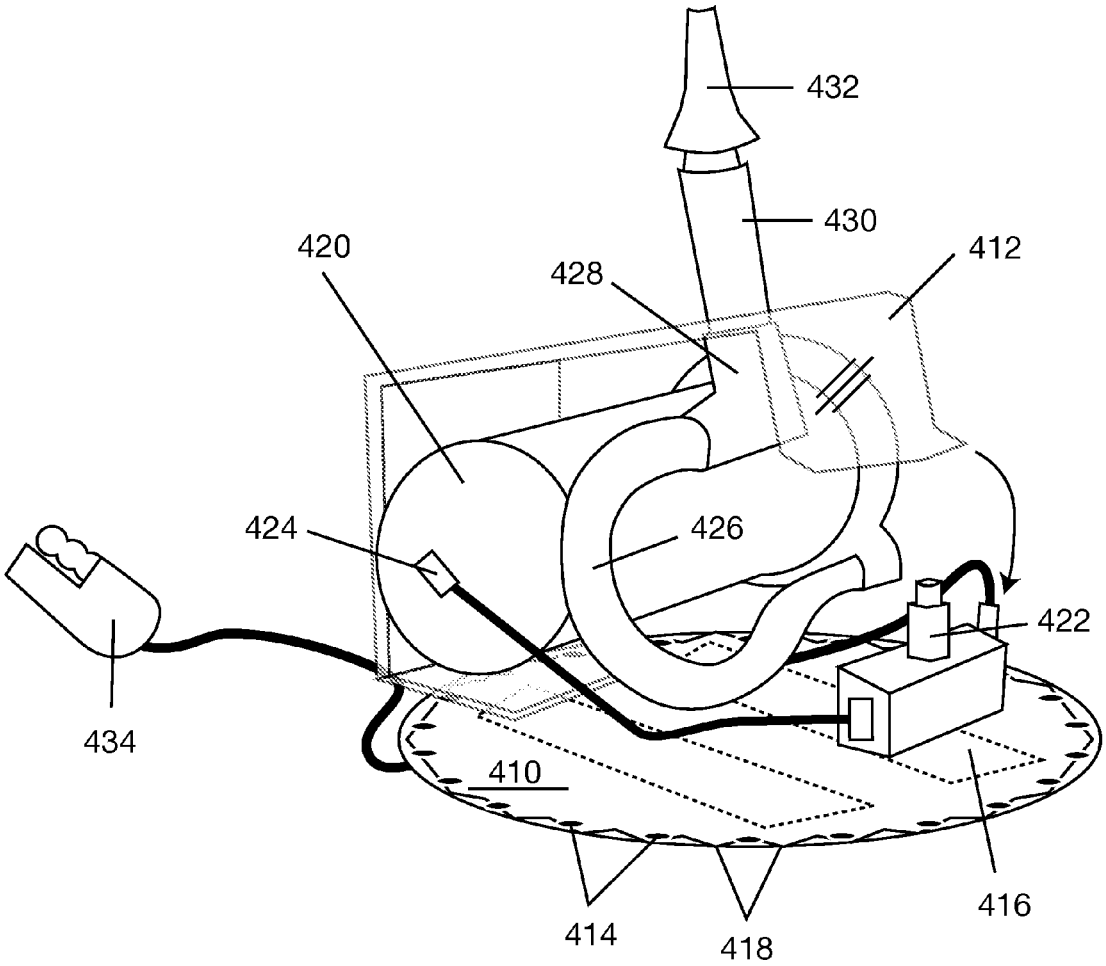
FIG. 4 shows a ¾ angle view of an exemplary air-creating mechanism.
Figure 5:
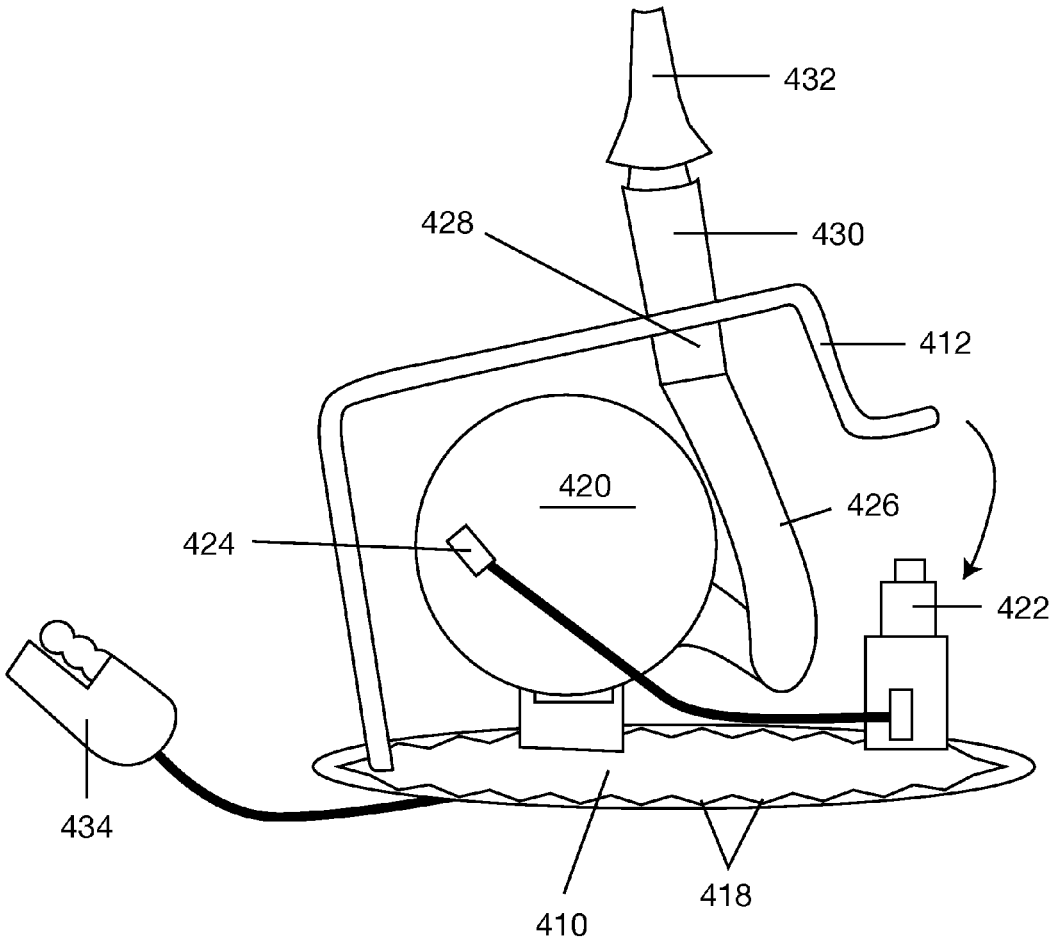
FIG. 5 shows a side angle view of an exemplary air-creating mechanism.
Figure 6:
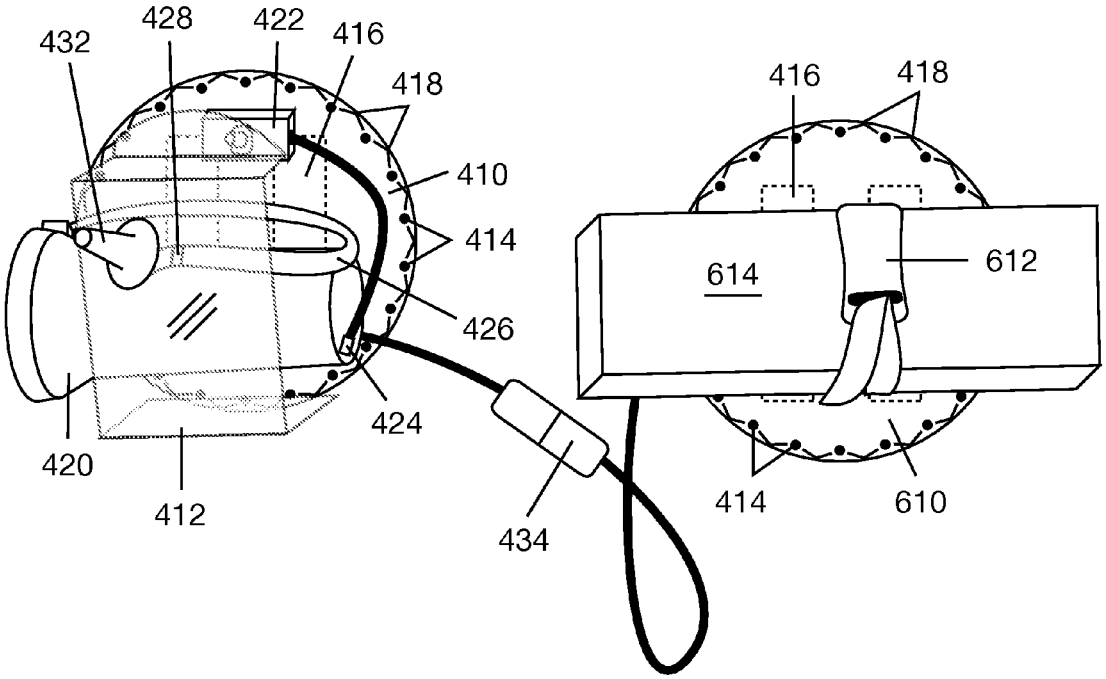
FIG. 6 shows an air-creating mechanism connected to a power source.

Both corset cups 112 may be furnished with disc-shaped interior padding 310 upon which two hook and loop strips are sewn 312. Said disc-shaped interior padding 310 may lay flat against the wearer's chest, creating a roomy hollow compartment in each breast cup 112, as seen in FIG. 3. This disc-shaped interior padding may be important for wearer's comfort and protection from the heat of the air-creating mechanism, which will be shown in FIG. 4. In this example, a small slit between each padded disc 310 and inside of each breast cup 112 is left open (not shown).

Grommets 116 on each cup 112 may allow for adequate air-intake and ventilation. In this embodiment, the grommets 116 are arranged in a decorative manner on both corset cups 112. While air-intake and ventilation are necessary, alternative ways of providing this may include hidden slits or air-permeable materials such as dark-painted screen, such as the type used in theme park big-head costume construction. Alternative air-creating devices used in other possible embodiments may not need ventilation.

This corset 110 houses the air-creating mechanism, the description of which follows in the next paragraph.

A transparent disc of, for example but not limited to a plastic material such as LEXAN 410 may be fitted with a flexible arm of material, which may be for example but not limited to, LEXAN 412 which his secured by screws (not shown). While LEXAN is used in this embodiment, any type of flexible, non-flammable material may be used.

Small holes 414 may be drilled around the LEXAN disc's 410 perimeter. In this variation, the LEXAN disc 410 is attached to a fabric backing complete with two hook and loop strips 416 sewn upon it. This fabric backing with hook and loop strips 416 may be affixed to the LEXAN disc 410 with stitching 418.

In this embodiment, an air compressor, for example but not limited to an automotive rotary air horn compressor 420 is affixed to the disc 410 and under the flexible arm 412 with nut and bolt hardware (not shown). A normally-open micro switch 422 is mounted to the LEXAN disc 410, and is connected to the automotive rotary air horn compressor 420 with standard electrical circuitry 424 known to those trained in the electrical field. In other embodiments, a small compressed air canister may be used to create a burst of air instead of a rotary air compressor 420. The advantage to using compressed air is it is lightweight and needs no power source. The disadvantage to compressed air is that it is not suitable for long performance periods during which the wearer might need to produce consistently robust streams of air.

In this example, clear plastic tubing 426 is fitted over the automotive air horn compressor's 420 air output pipe (not shown) and secured with nylon cable ties (not shown). While this variation employs clear plastic tubing, other air-focusing tools may be used. The other end of the clear plastic tubing 426 then fits over the narrow end of a 90-degree compression fitting 428 and is again secured with nylon cable ties (not shown). The male end of the 90-degree compression fitting 428 fits through a hole (not shown) drilled through the LEXAN arm 412. A galvanized coupling 430 with two female ends screws onto the 90-degree compression fitting 428 on the top side of the LEXAN arm 412, and a nozzle 432 screws into the end of this galvanized coupling 430. In this embodiment, the galvanized coupling 430 is used to provide extra height to fit properly in the corset cups 112. In other embodiments, for instance if the compressor 420 is housed in the groin area of a costume garment, no galvanized coupling 430, or a longer galvanized coupling 430, may be used.

In this example, the electrical circuitry 424 is finished with a 12-volt 2 prong connector 434.

In this example, a second LEXAN disc 610 is also equipped with small holes 414 and two thin slits (not shown) through which a hook and loop strap 612 is threaded. This second LEXAN disc 610 also affixed with stitching 418 to a fabric backing 416 upon which two hook and loop strips 312 are sewn. A rechargeable sealed lead acid battery 614 is connected via standard electrical circuitry to a 12-volt 2 prong connector 434. The sealed lead acid battery 614 is secured to the second LEXAN disc 610 with the hook and loop strap 612.

Figure 7:
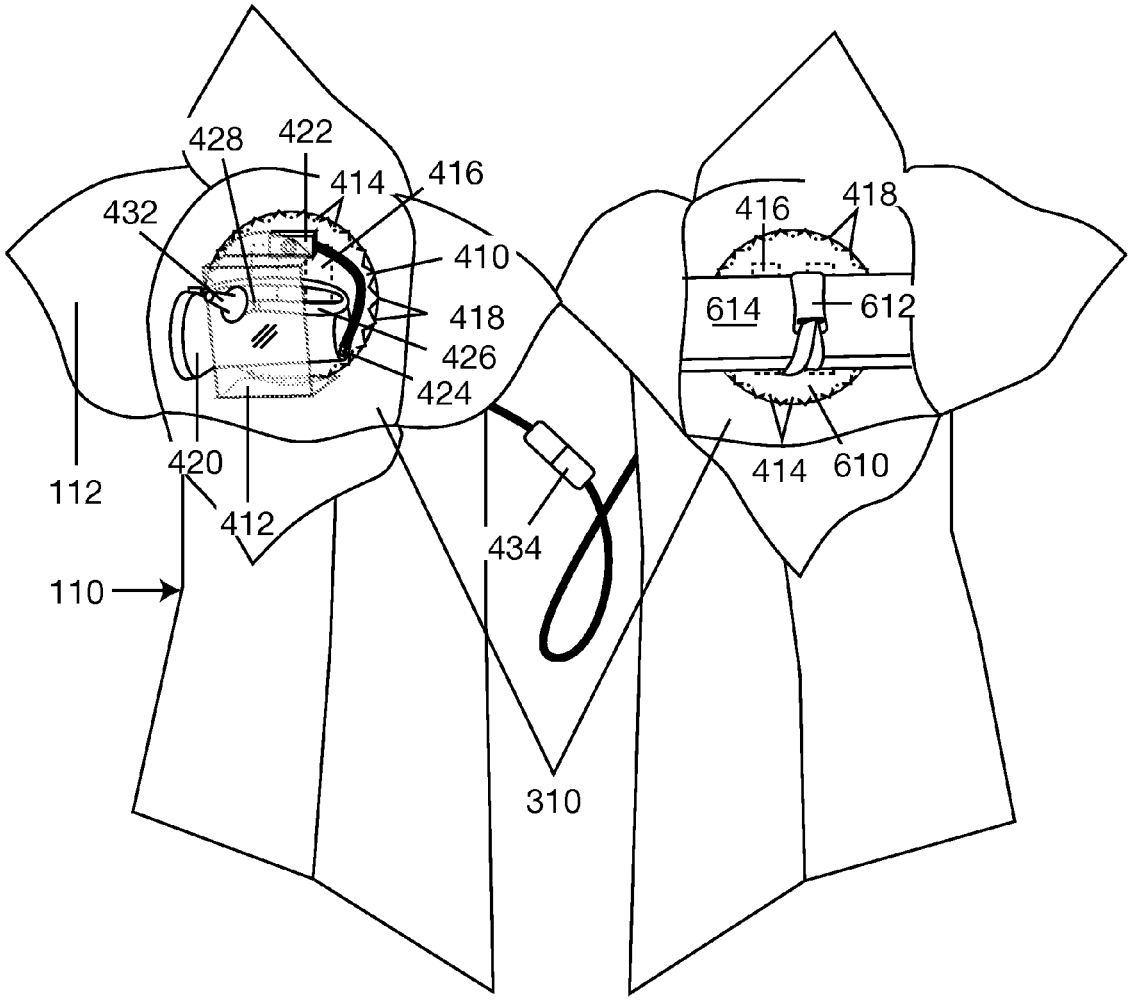
FIG. 7 shows an exemplary corset garment open with an air-creating mechanism and power source secured inside a hollow compartment.

Both LEXAN discs 410 and 610 are then affixed inside the corset cups 112 by aligning the hook and loop strips 312 and 416 and pressing firmly. This can be clearly seen in FIG. 7. The electrical cords from both the automotive air horn compressor 420 and the battery 614 are threaded through the slit opening (not shown) between the disc-shaped interior padding 310 and the interior of the corset cups 112. The corset cups 112 are then closed with the zippers (indicated by thick black lines in FIGS. 1, 2, 8 and 9), hiding the air-creating device, and leaving the nozzle 432 to protrude from one corset cup 112, while the battery 614 is camouflaged and contained in the other corset cup 112, as seen in FIGS. 8 and 9.

The performer dons the corset 110, and then connects the battery 613 to the automotive rotary air horn compressor with 12-volt 2 connectors 434. Then the performer closes the front of the corset with a zipper (not shown), and is ready to use the costume, as it appears in FIGS. 8 and 9.

Figure 8:
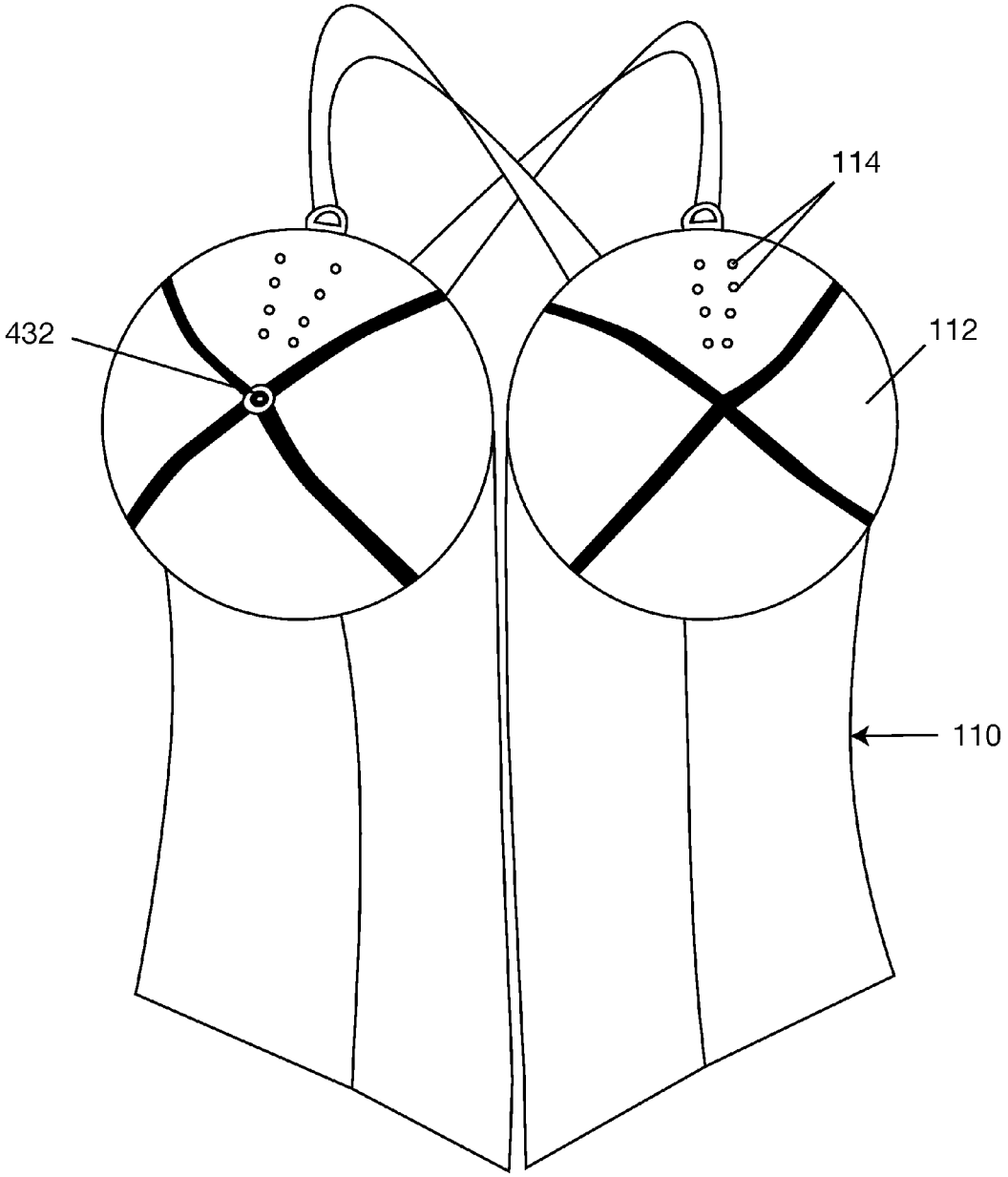
FIG. 8 shows a corset garment.
Figure 9:
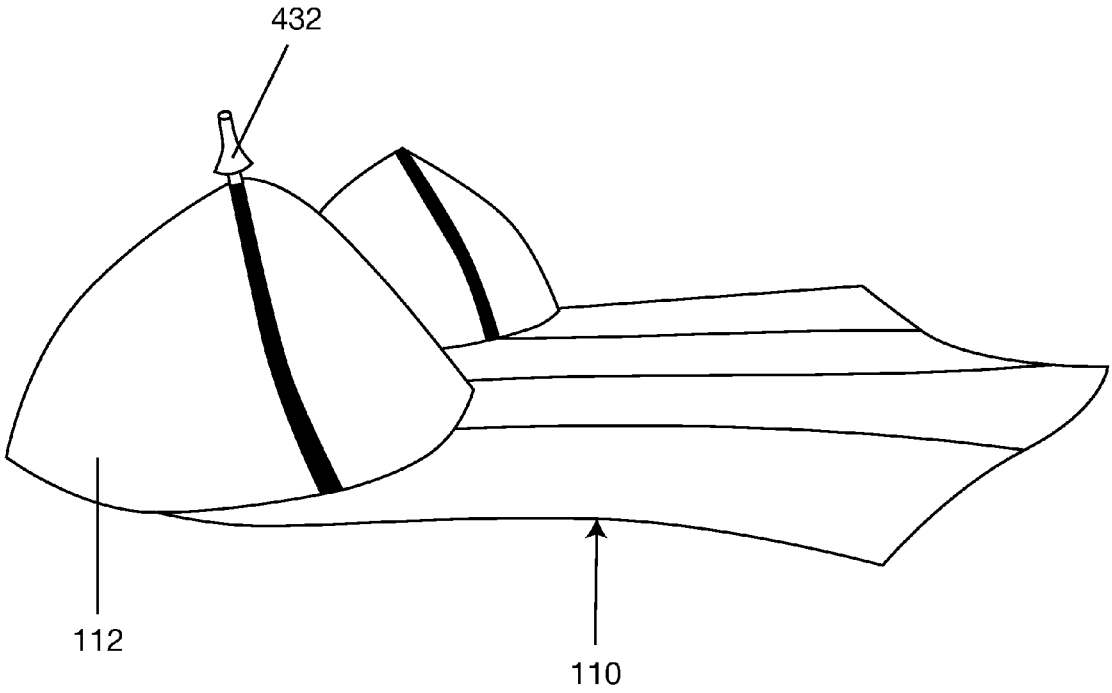
FIG. 9 shows a side view of a corset garment.

To use this embodiment of the costume, the wearer dons the completed costume as seen in FIGS. 8 and 9. The wearer holds a balloon in one hand (not shown), affixes it to the nozzle 432 protruding from the corset cup 112, and pressed down with said hand. Unseen by viewers, inside the corset cups 112, the LEXAN arm 412 flexes from the pressure, pushing down upon the normally-open micro switch 422, which activates the automotive rotary air horn compressor 420, thus creating a stream of air and inflating the balloon.

This embodiment and other embodiments may use the air-creating device for other entertaining purposes, such as inflating objects other than balloons, to propel substances like confetti or glitter into the surrounding air, for operating amusement devices such as party noisemakers or pinwheels, or for extinguishing small flames.

Thus, the reader will see that at least one embodiment of the invention provides easy, one-handed, visually attractive and amusing balloon inflation.

While the above description contains many specificities, these should not be construed as limitations on the scope of the embodiments thereof. Many other ramifications and variations are possible within the teachings of the various embodiments. For example, the air-creating device may be a compressed air canister, a foot pump, or a device not yet envisioned or created. The air may appear to be emitted from another anatomical area, such as the head or hairstyle, the groin, the limbs and extremities, or from the posterior, as if by flatulence. The costume may be configured to visually replicate other physical characteristics, and could appear as a Wagnerian Soprano's breast-plated costume, a Cow's torso, a Woman's Braids, or even a Business Man's suit, among others. The stream of air may be used to inflate other inflatable objects than balloons, or for other applications than inflation; for instance, substances like confetti or glitter may be propelled into the surrounding air, amusement devices such as party noisemakers or pinwheels may be activated, or small flames may be extinguished.

Thus the scope of the invention should be determined by the appended claims and their legal equivalents, and not by the examples given.

I claim:

1. A costume for a wearer comprising:

a corset garment;

the corset garment dimensioned to accommodate the chest of a wearer;

the corset garment comprising at least one cup;

the at least one cup comprising an outer surface which is viewable to the public and an inner surface which is hidden from public view;

the at least one cup defining a hollow compartment;

the outer surface comprising grommets capable of both air-intake into the hollow compartment and ventilation of air out of the hollow compartment;

the hollow compartment containing therein an air-creating mechanism;

the air-creating mechanism connected to a battery;

the air-creating mechanism comprising a nozzle;

the nozzle protruding from the outer surface of the at least one cup;

such that the air-creating mechanism emits a focused stream of air capable of inflating a balloon removably affixed to the nozzle.

2. The costume according to claim 1, each of the at least one cup further comprising four panels.

3. The costume according to claim 2, the four panels comprising a zipper between each of the four panels configured to permit the wearer to gain access to access the air-creating mechanism.

4. The costume according to claim 1, the at least one cup comprising interior padding.

5. The costume according to claim 4, the interior padding further comprising at least one hook and loop strip.

6. The costume according to claim 1, the air-creating mechanism comprising an automotive rotary air horn compressor.

7. The costume according to claim 1, the air-creating mechanism comprising a compressed air canister.

* * * * *